US005758373A

United States Patent [19]

Bloetjes

[11] Patent Number: 5,758,373

[45] Date of Patent: Jun. 2, 1998

[54] SECURITY BEACH BLANKET

[76] Inventor: Richard Bloetjes, 121 Passaic Ave., Hawthorne, N.J. 07506

[21] Appl. No.: 911,094

[22] Filed: Aug. 14, 1997

[51] Int. Cl.[6] ..... A47G 9/06

[52] U.S. Cl. ..... 5/417; 5/485; 2/252

[58] Field of Search ..... 5/417–420, 485; 428/77–79; 2/252, 249

[56] References Cited

U.S. PATENT DOCUMENTS

| | | | |
|---|---|---|---|
| 4,468,823 | 9/1984 | Tounjian | 5/417 |
| 4,703,528 | 11/1987 | Rolle | 5/417 |
| 4,885,195 | 12/1989 | Change, III | 5/417 |
| 5,018,229 | 5/1991 | Eberhart | 5/417 |
| 5,279,009 | 1/1994 | Putka, Jr. | 5/485 |
| 5,443,880 | 8/1995 | Wike | 5/417 |

*Primary Examiner*—Alexander Grosz

[57] ABSTRACT

A new security beach blanket for ensuring valuables are secure when on a beach. The inventive device includes a blanket portion having a slotted opening therethrough. The slotted opening has a zippered closure coupled therewith. The zippered closure has a ring extending upwardly therefrom. A pair of flaps are foldably coupled with the blanket portion on opposing ends of the zippered closure. Each of the flaps have a slot therethrough whereby a first flap is folded over the zippered closure with the slot thereof receiving the ring therethrough and a second flap is folded over the first flap with the slot thereof receiving the ring therethrough. A padlock couples with the ring. A rubber pouch is secured to a lower surface of the blanket portion. The rubber pouch has an open upper end disposed below the slotted opening of the blanket portion.

7 Claims, 2 Drawing Sheets

SECURITY BEACH BLANKET

BACKGROUND OF THE INVENTION

1. Field of the Invention

The present invention relates to beach towels with pockets and more particularly pertains to a new security beach blanket for ensuring valuables are secure when on a beach.

2. Description of the Prior Art

The use of beach towels with pockets is known in the prior art. More specifically, beach towels with pockets heretofore devised and utilized are known to consist basically of familiar, expected and obvious structural configurations, notwithstanding the myriad of designs encompassed by the crowded prior art which have been developed for the fulfillment of countless objectives and requirements.

Known prior art beach towels with pockets include U.S. Pat. No. 5,361,435 to Reeves; U.S. Pat. No. 5,072,467 to Hunt; U.S. Pat. No. Des. 341,285 to Kraus; U.S. Pat. No. 4,654,906 to Roberts; U.S. Pat. No. 5,406,659 to Camp; and U.S. Pat. No. 4,466,516 to Sicoli et al.

While these devices fulfill their respective, particular objectives and requirements, the aforementioned patents do not disclose a new security beach blanket. The inventive device includes a blanket portion having a slotted opening therethrough. The slotted opening has a zippered closure coupled therewith. The zippered closure has a ring extending upwardly therefrom. A pair of flaps are foldably coupled with the blanket portion on opposing ends of the zippered closure. Each of the flaps have a slot therethrough whereby a first flap is folded over the zippered closure with the slot thereof receiving the ring therethrough and a second flap is folded over the first flap with the slot thereof receiving the ring therethrough. A padlock couples with the ring. A rubber pouch is secured to a lower surface of the blanket portion. The rubber pouch has an open upper end disposed below the slotted opening of the blanket portion.

In these respects, the security beach blanket according to the present invention substantially departs from the conventional concepts and designs of the prior art, and in so doing provides an apparatus primarily developed for the purpose of ensuring valuables are secure when on a beach.

SUMMARY OF THE INVENTION

In view of the foregoing disadvantages inherent in the known types of beach towels with pockets now present in the prior art, the present invention provides a new security beach blanket construction wherein the same can be utilized for ensuring valuables are secure when on a beach.

The general purpose of the present invention, which will be described subsequently in greater detail, is to provide a new security beach blanket apparatus and method which has many of the advantages of the beach towels with pockets mentioned heretofore and many novel features that result in a new security beach blanket which is not anticipated, rendered obvious, suggested, or even implied by any of the prior art beach towels with pockets, either alone or in any combination thereof.

To attain this, the present invention generally comprises a blanket portion having a generally rectangular configuration. The blanket has a slotted opening through a central portion thereof. The slotted opening has a zippered closure coupled therewith. The zippered closure has a ring extending upwardly therefrom. A pair of flaps are foldably coupled with the blanket portion on opposing ends of the zippered closure. Each of the flaps has a slot therethrough whereby a first flap is folded over the zippered closure with the slot thereof receiving the ring therethrough and a second flap is folded over the first flap with the slot thereof receiving the ring therethrough. A padlock couples with the ring. A rubber pouch is secured to a lower surface of the blanket portion. The rubber pouch has an open upper end disposed below the slotted opening of the blanket portion. Four stakes extend through four corners of the blanket portion. Each of the stakes extends through a grommet disposed within one of the four corners of the blanket portion. A pair of securement straps are coupled with two of the stakes. Each of the straps has an interior end with a grommet disposed therein for receiving the stake therethrough and a looped exterior end. The looped exterior end is defined by a pair of grommets therethrough in a spaced relationship wherein alignment of the pair of grommets forms the loop.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new security beach blanket apparatus and method which has many of the advantages of the beach towels with pockets mentioned heretofore and many novel features that result in a new security beach blanket which is not anticipated, rendered obvious, suggested, or even implied by any of the prior art beach towels with pockets, either alone or in any combination thereof.

It is another object of the present invention to provide a new security beach blanket which may be easily and efficiently manufactured and marketed.

It is a further object of the present invention to provide a new security beach blanket which is of a durable and reliable construction.

An even further object of the present invention is to provide a new security beach blanket which is susceptible of a low cost of manufacture with regard to both materials and labor, and which accordingly is then susceptible of low prices of sale to the consuming public, thereby making such security beach blanket economically available to the buying public.

Still yet another object of the present invention is to provide a new security beach blanket which provides in the apparatuses and methods of the prior art some of the advantages thereof, while simultaneously overcoming some of the disadvantages normally associated therewith.

Still another object of the present invention is to provide a new security beach blanket for ensuring valuables are secure when on a beach.

Yet another object of the present invention is to provide a new security beach blanket which includes a blanket portion having a slotted opening therethrough. The slotted opening has a zippered closure coupled therewith. The zippered closure has a ring extending upwardly therefrom. A pair of flaps are foldably coupled with the blanket portion on opposing ends of the zippered closure. Each of the flaps have a slot therethrough whereby a first flap is folded over the zippered closure with the slot thereof receiving the ring therethrough and a second flap is folded over the first flap with the slot thereof receiving the ring therethrough. A padlock couples with the ring. A rubber pouch is secured to a lower surface of the blanket portion. The rubber pouch has an open upper end disposed below the slotted opening of the blanket portion.

Still yet another object of the present invention is to provide a new security beach blanket that provides peace of mind when at the beach.

Even still another object of the present invention is to provide a new security beach blanket that will not be blown away with the wind.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
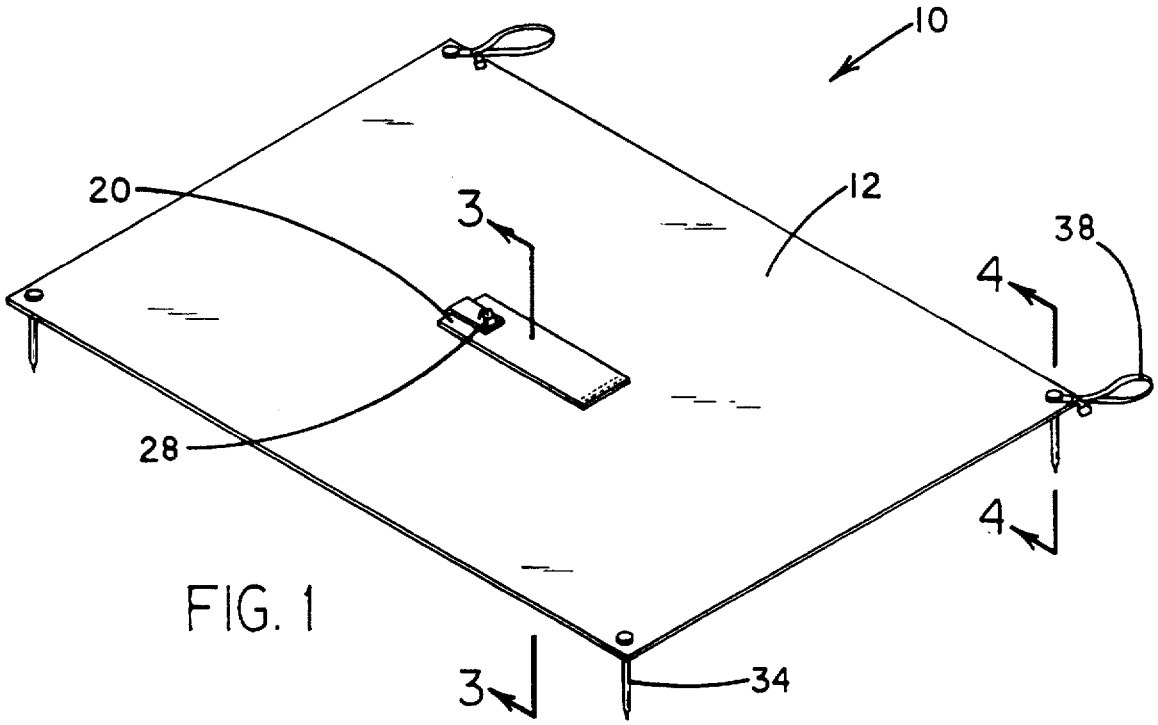
FIG. 1 is a perspective view of a new security beach blanket according to the present invention.
Figure 2:
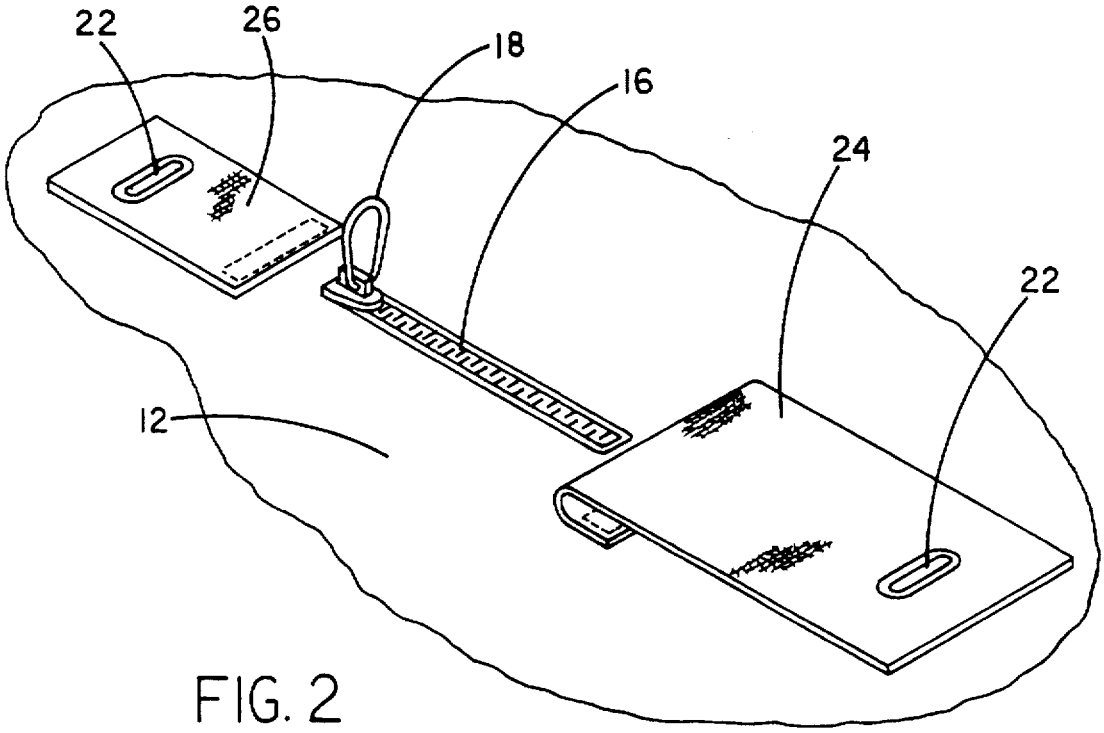
FIG. 2 is a partial perspective view of the present invention illustrating the opposed flaps and the zippered closure thereof.
Figure 3:
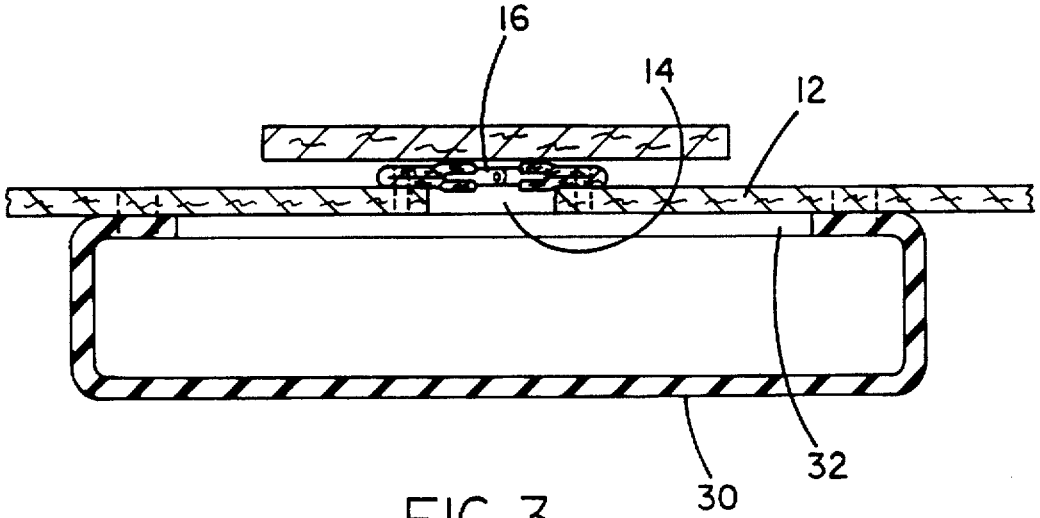
FIG. 3 is a cross-sectional view of the present invention as taken along line 3—3 of FIG. 1.
Figure 4:
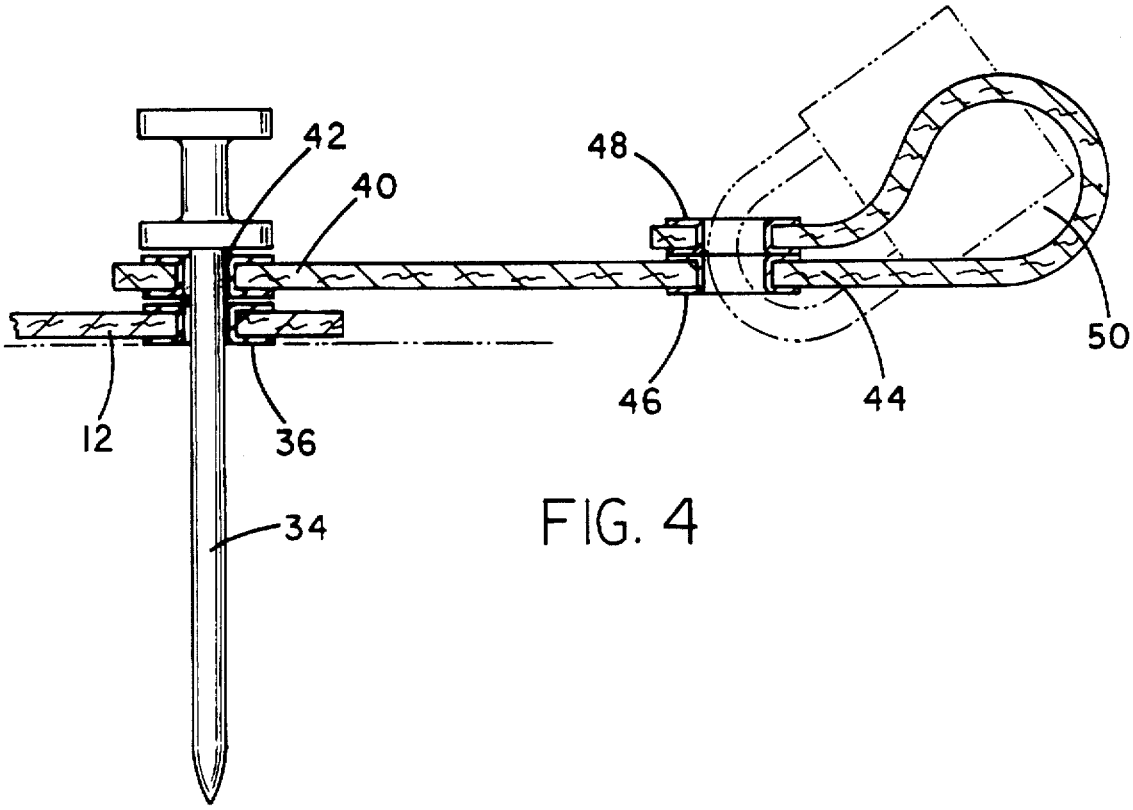
FIG. 4 is a cross-sectional view of the present invention as taken along line 4—4 of FIG. 1.

With reference now to the drawings, and in particular to FIGS. 1 through 4 thereof, a new security beach blanket embodying the principles and concepts of the present invention and generally designated by the reference numeral 10 will be described.

As best illustrated in FIGS. 1 through 4, the security beach blanket 10 COMPRISES A BLANKET PORTION 12 having a generally rectangular configuration. The blanket 12 has a slotted opening 14 through a central portion thereof. The slotted opening 14 has a zippered closure 16 coupled therewith. The zippered closure 16 has a ring 18 extending upwardly therefrom.

A pair of flaps 20 are foldably coupled with the blanket portion 12 on opposing ends of the zippered closure 16. Each of the flaps 20 has a slot 22 therethrough whereby a first flap 24 is folded over the zippered closure 16 with the slot thereof receiving the ring 18 therethrough and a second flap 26 is folded over the first flap 24 with the slot thereof receiving the ring 18 therethrough. A padlock 28 couples with the ring 18.

A rubber pouch 30 is secured to a lower surface of the blanket portion 12. The rubber pouch 30 has an open upper end 32 disposed below the slotted opening 14 of the blanket portion 12.

Four stakes 34 extend through four corners of the blanket portion 12. Each of the stakes 34 extends through a grommet 36 disposed within one of the four corners of the blanket portion 12.

A pair of securement straps 38 are coupled with two of the stakes 34. Each of the straps 38 has an interior end 40 with a grommet 42 disposed therein for receiving the stake 34 therethrough and a looped exterior end 44. The looped exterior end 44 is defined by a pair of grommets 46,48 therethrough in a spaced relationship wherein alignment of the pair of grommets 46,48 forms the loop 50.

In use, the present invention consists of a standard beach blanket portion 12 incorporating a waterproof rubber pouch 30 stitched to the center of its underside. When the blanket portion 12 is in use, the rubber pouch 30 would be pressed down into the sand and concealed from view. The zippered closure 16 would provide access to the contents of the rubber pouch 30. The pair of flaps 20 are positioned atop the zippered closure 16 in order to conceal it. The padlock 28 is employed through the ends of the flaps 20 to ensure the zippered closure 16 remained closed and the valuables safely stored within the rubber pouch 30. The rubber pouch 30 could store a wide array of items including money, keys, credit cards, identification, etc. The blanket portion 12 includes four grommets 36 disposed within its corners with the four stakes 34 positioned through the grommets 36 and anchored within the sand or ground to hold the blanket portion 12 in place. Thus, the blanket portion 12 would not be blown away by a gust of wind. The securement straps 38 are employed to secure items such as coolers and radios in place.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A security beach blanket for ensuring valuables are secure when on a beach comprising, in combination:

a blanket portion having a generally rectangular configuration, the blanket having a slotted opening through a central portion thereof, the slotted opening having a zippered closure coupled therewith, the zippered closure having a ring extending upwardly therefrom;

a pair of flaps foldably coupled with the blanket portion on opposing ends of the zippered closure, each of the flaps having a slot therethrough whereby a first flap is folded over the zippered closure with the slot thereof receiving the ring therethrough and a second flap is folded over the first flap with the slot thereof receiving the ring therethrough, a padlock coupling with the ring;

a rubber pouch secured to a lower surface of the blanket portion, the rubber pouch having an open upper end disposed below the slotted opening of the blanket portion;

four stakes extending through four corners of the blanket portion, each of the stakes extending through a grommet disposed within one of the four corners of the blanket portion; and a pair of securement straps coupled with two of the stakes, each of the straps having an interior end with a grommet disposed therein for receiving the stake therethrough and a looped exterior end, the looped exterior end being defined by a pair of grommets therethrough in a spaced relationship wherein alignment of the pair of grommets forming the loop.

2. A security beach blanket for ensuring valuables are secure when on a beach comprising, in combination:

a blanket portion having a slotted opening therethrough, the slotted opening having a zippered closure coupled therewith, the zippered closure having a ring extending upwardly therefrom;

a pair of flaps foldably coupled with the blanket portion on opposing ends of the zippered closure, each of the flaps having a slot therethrough whereby a first flap is folded over the zippered closure with the slot thereof receiving the ring therethrough and a second flap is folded over the first flap with the slot thereof receiving the ring therethrough, a padlock coupling with the ring; and a rubber pouch secured to a lower surface of the blanket portion, the rubber pouch having an open upper end disposed below the slotted opening of the blanket portion.

3. The security beach blanket as set forth in claim 2 and further including four stakes extending through four corners of the blanket portion.

4. The security beach blanket as set forth in claim 3 wherein each of the stakes extends through a grommet disposed within one of the four corners of the blanket portion.

5. The security beach blanket as set forth in claim 3 and further including a pair of securement straps coupled with two of the stakes.

6. The security beach blanket as set forth in claim 5 wherein each of the straps have an interior end with a grommet disposed therein for receiving the stake therethrough and a looped exterior end.

7. The security beach blanket as set forth in claim 6 wherein the looped exterior ends are defined by a pair of grommets therethrough in a spaced relationship wherein alignment of the pair of grommets forming the loop.

* * * * *